US011492876B2

(12) United States Patent
Penno et al.

(10) Patent No.: US 11,492,876 B2
(45) Date of Patent: Nov. 8, 2022

(54) SAND SCREEN SYSTEM WITH ADHESIVE BONDING

(71) Applicant: Halliburton Energy Services, Inc., Houston, TX (US)

(72) Inventors: Andrew David Penno, Singapore (SG); Maxime P M Coffin, Frisco, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 815 days.

(21) Appl. No.: 16/326,029

(22) PCT Filed: Aug. 14, 2018

(86) PCT No.: PCT/US2018/046713
§ 371 (c)(1),
(2) Date: Feb. 15, 2019

(87) PCT Pub. No.: WO2019/055166
PCT Pub. Date: Mar. 21, 2019

(65) Prior Publication Data

US 2021/0355793 A1 Nov. 18, 2021

Related U.S. Application Data

(60) Provisional application No. 62/558,985, filed on Sep. 15, 2017.

(51) Int. Cl.

| | |
|---|---|
| ***E21B 43/08*** | (2006.01) |
| ***E21B 43/10*** | (2006.01) |
| ***E21B 17/10*** | (2006.01) |

(52) U.S. Cl.
CPC ..... *E21B 43/084* (2013.01); *E21B 17/1078* (2013.01); *E21B 43/10* (2013.01)

(58) Field of Classification Search
CPC .... E21B 17/1078; E21B 49/04; E21B 49/084; E21B 49/086; E21B 49/188; E21B 49/10; B07B 1/46; B07B 2201/02
See application file for complete search history.

(56) References Cited

U.S. PATENT DOCUMENTS 130,871 A * 8/1872 Rouse ..... E21B 43/084 166/230
160,692 A * 3/1875 Macomber ..... E21B 43/084 166/230

(Continued)

FOREIGN PATENT DOCUMENTS

WO 03014521 2/2003
WO WO-03078789 A1 * 9/2003 ..... E21B 17/1078

OTHER PUBLICATIONS

International Patent Application No. PCT/US2018/046713 , "International Search Report and Written Opinion", dated Jan. 2, 2019, 15 pages.

*Primary Examiner* — Jennifer H Gay
(74) *Attorney, Agent, or Firm* — Kilpatrick Townsend & Stockton LLP

(57) ABSTRACT

A sand screen system includes a tubular. The tubular includes at least one through-port from an outer surface of the tubular to an inner surface of the tubular. Further, the sand screen system includes a filtering portion positioned over the at least one through-port on the outer surface of the tubular. A moldable material couples the filtering portion to the tubular.

20 Claims, 7 Drawing Sheets

(56) References Cited

U.S. PATENT DOCUMENTS 470,274 A * 3/1892 Wiser ..... E21B 43/086 166/229
1,963,629 A * 6/1934 Mark ..... E21B 43/086 72/370.27
3,981,359 A * 9/1976 Fortenberry ..... E21B 17/1078 166/241.6
4,284,138 A * 8/1981 Allred ..... E21B 43/088 166/233
4,352,512 A * 10/1982 Janssen ..... B01D 29/012 285/419
4,681,161 A * 7/1987 Arterbury ..... E21B 43/088 166/227
4,770,336 A * 9/1988 Arterbury ..... E21B 17/1078 166/227
5,411,084 A * 5/1995 Padden ..... E21B 43/088 166/230
5,509,483 A * 4/1996 Graen ..... E21B 43/088 166/227
6,305,468 B1 * 10/2001 Broome ..... E21B 43/08 29/896.62
7,096,939 B2 * 8/2006 Kirk ..... E21B 17/1078 166/206
10,072,482 B2 * 9/2018 Hodge ..... E21B 43/084
2002/0092649 A1 * 7/2002 Bixenman ..... E21B 43/04 166/278
2002/0129935 A1 9/2002 Castano-Mears et al.
2005/0150654 A1 * 7/2005 Kirk ..... E21B 43/103 166/206
2008/0217002 A1 9/2008 Simonds et al.
2009/0179383 A1 * 7/2009 Koloy ..... E21B 33/1208 277/338
2011/0011586 A1 * 1/2011 Dusterhoft ..... E21B 43/08 166/278
2011/0036565 A1 * 2/2011 Holderman ..... E21B 43/103 166/227
2012/0037357 A1 * 2/2012 Lopez ..... E21B 43/088 29/505
2012/0073801 A1 * 3/2012 Greci ..... E21B 43/08 166/227
2015/0013970 A1 * 1/2015 Jaaskelainen ..... E21B 47/135 166/250.01
2016/0040516 A1 2/2016 Richards
2017/0022789 A1 * 1/2017 Hodge ..... E21B 43/045
2017/0074077 A1 * 3/2017 Bowen ..... E21B 43/086
2018/0283134 A1 * 10/2018 Ornelaz ..... E21B 49/08
2019/0112900 A1 * 4/2019 Osunjaye ..... E21B 43/086
2019/0195052 A1 * 6/2019 Yi ..... E21B 43/04

* cited by examiner

SAND SCREEN SYSTEM WITH ADHESIVE BONDING

CROSS-REFERENCE TO RELATED APPLICATIONS

This disclosure claims priority to U.S. Provisional Patent Application Ser. No. 62/558,985, titled "Composite Resin Screen" and filed Sep. 15, 2017, the entirety of which is incorporated herein by reference.

TECHNICAL FIELD

The present disclosure relates to sand screens used in hydrocarbon production. More specifically, this disclosure relates to sand screens attached to a tubular with a composite resin, other adhesive material, or another sealing material able to form a barrier between the sand screen and the tubular.

BACKGROUND

In hydrocarbon-producing wells, sand screens may be used to filter sand and other debris out of production fluids produced from the hydrocarbon well to a surface. Construction of the sand screens on tubing generally relies on welding the sand screen components to the tubing or using mechanical attachment mechanisms (e.g., screws, bolts, etc.) to attach the sand screen components to the production tubing. Welding or otherwise mechanically attaching the sand screen components to various alloys may be particularly challenging, and skilled labor with significant training and experience may be relied upon to perform such attachment. Moreover, various materials used for the tubing and the sand screen components may not withstand the welding environment or form an adequate seal between the tubing and the sand screen components when other mechanical attachment mechanisms are used.

DETAILED DESCRIPTION

Certain aspects and examples of the disclosure relate to sand screen systems with composite resin or other adhesive bonding of a sand screen to a tubular. Components of the sand screen may be constructed to significantly reduce cost as well as to provide easy local (e.g., in country) manufacturing. A protective shroud, a mesh filter, a drainage layer, other sand screen components, or any combination thereof of the sand screen may be chemically fixed to the tubular to remove costs through limiting a number of components used for the sand screen assembly. Further, chemically fixing the mesh portion of the sand screen may reduce a number of processes and hours used for assembly in comparison to current sand screen manufacturing processes.

Chemically fixing the sand screen to the tubular may include coupling the sand screen to the tubular using a composite resin or other adhesive material (e.g., a moldable material). The composite resin may include a carbon fiber ceramic material, but other composite resins, silicones, epoxies, and adhesives may also be used. The composite resin or other adhesive material may be molded into a desired size and shape, and the composite resin or other adhesive material may create a sand-tight seal between the sand screen and the tubular while also providing adhesive and mechanical integrity. The sand-tight seal may prevent any debris from entering the tubular that is larger than debris that the sand screen is able to pass through to the tubular.

Because the sand screen is chemically fixed to the tubular, other mechanical fasteners (e.g., bolts or screws) may be avoided, or a number of the mechanical fasteners used to install the sand screen to the tubular may be reduced. For example, a limited number of mechanical fasteners may maintain the sand screen in proper alignment with the tubular while the composite resin, other adhesive material, or other sealing material is applied to create the sand-tight seal between the sand screen and the tubular. In other examples, the other mechanical fasteners are avoided altogether when the sand screen is chemically fixed to the tubular. In some examples, as discussed below with respect to FIG. 6, fasteners can be added within the molded material to provide increased mechanical strength.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
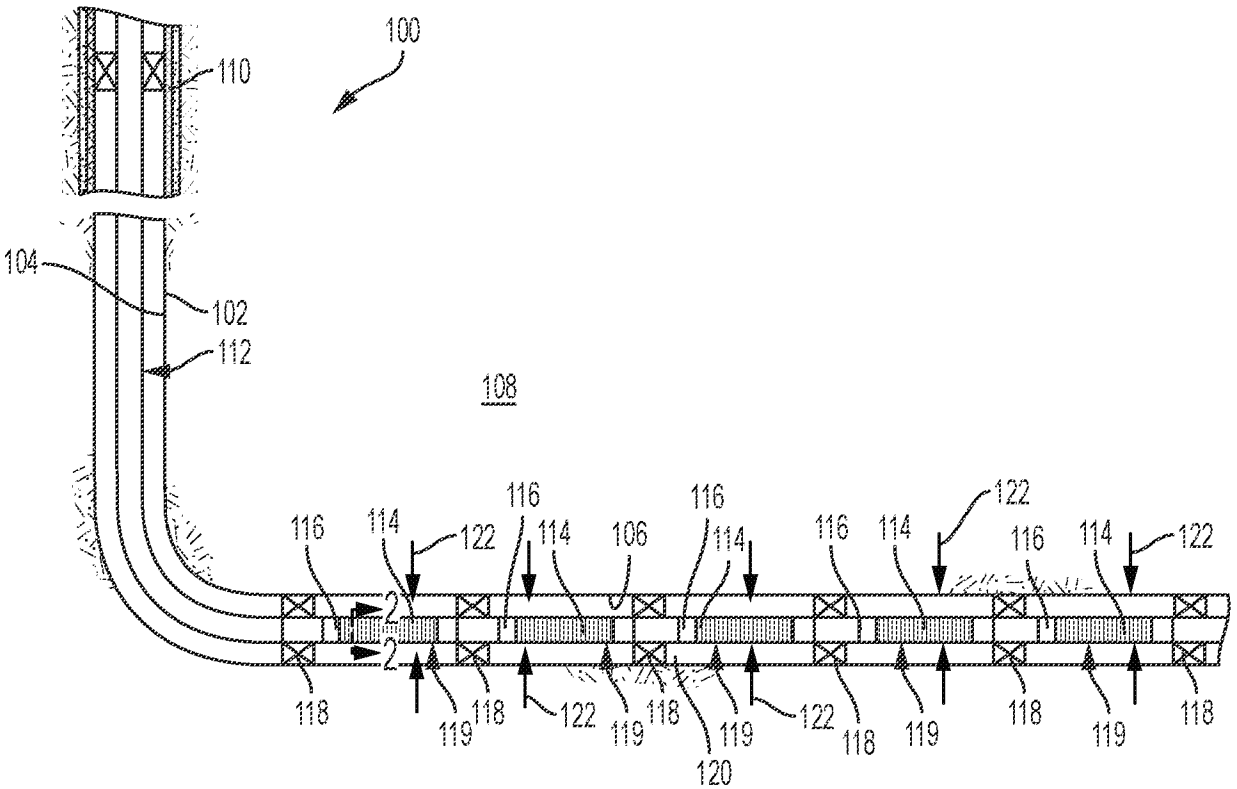
FIG. 1 is a cross-sectional view of an example of a well system that includes a series of sand screens according to some aspects of the present disclosure.

FIG. 1 is a cross-sectional view of an example of a well system 100 according to some aspects. The well system 100 may include a wellbore 102 with a generally vertical section 104 that transitions into a generally horizontal section 106 extending through a subterranean earth formation 108. In an example, the vertical section 104 may extend in a downhole direction from a portion of the wellbore 102 having a cemented in casing string 110. A tubular string, such as a production tubing string 112, may be installed or extended into the wellbore 102.

One or more sand screens 114, one or more inflow control devices 116, and one or more packers 118 may be interconnected along the production tubing string 112, such as along tubulars 119 positioned along the horizontal section 106 of the wellbore 102. The tubulars 119 may be attached to a downhole end of the production tubing string 112. The packers 118 may seal off an annulus 120 located between the tubulars 119 and walls of the wellbore 102. As a result, fluids 122 may be produced from multiple intervals or "pay zones" of the formation 108 through isolated portions of the annulus 120 between adjacent pairs of packers 118.

In an example, a sand screen 114 and an inflow control device 116 may be interconnected in the production tubing string 112 and positioned between a pair of packers 118. The sand screens 114 may be any type of sand screen that are capable of coupling to the tubulars 119 using a composite resin or other chemical binding agent (e.g., another adhesive material). In operation, the sand screen 114 may filter the fluids 122 flowing into the tubulars 119 from the formation 108 and through the annulus 120. The inflow control device 116 may also optionally be positioned along the tubulars 119. When in position, the inflow control device 116 may restrict or otherwise regulate a flow of the fluids 122 into the production tubing string 112 based on certain physical or chemical characteristics of the fluids 122 and the inflow control device 116.

While the well system 100 is described as including multiple tubulars 119, multiple inflow control devices 116, and multiple packers 118, these described components may not be used in every example in which the sand screen 114 is used. For example, the well system 100 may include only an individual tubular 119, and the sand screen 114 may be coupled to the individual tubular 119 without an accompanying inflow control device 116. Further, an example using the sand screen 114 may be implemented without the packers 118 isolating the various sections of the formation 108.

Figure 2:
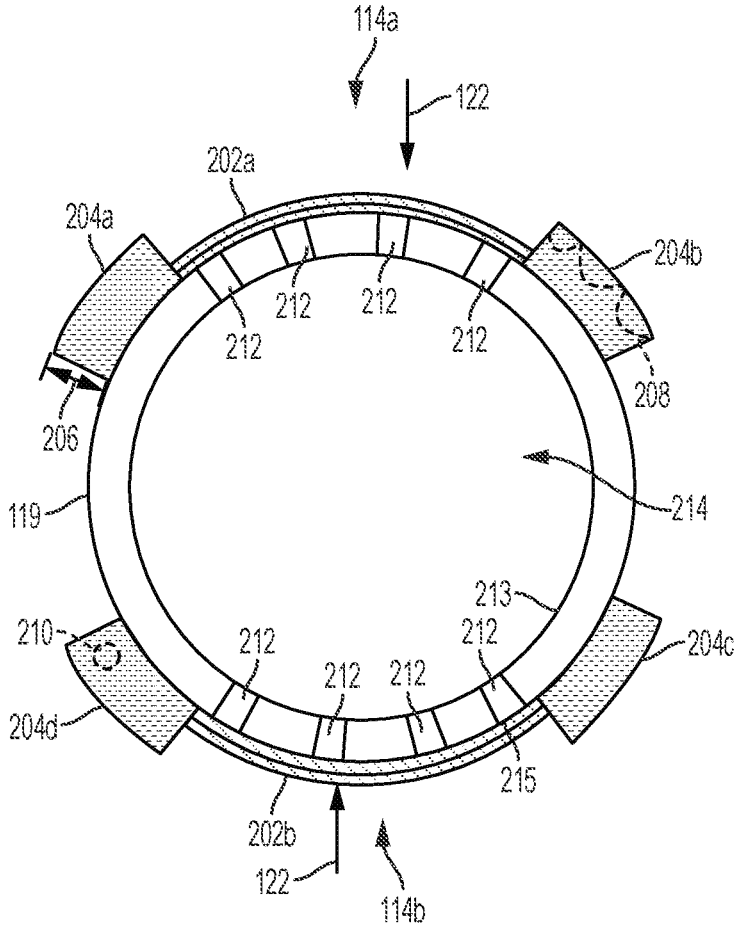
FIG. 2 is a sectional view of a sand screen of the well system of FIG. 1 according to some aspects of the present disclosure.

FIG. 2 is a sectional view of sand screens 114*a* and 114*b* of the well system 100 according to some aspects. Filtering portions 202*a* and 202*b* may be mesh-type screens (e.g., a sintered mesh panel or other type of single-layer or wire wrap section, or a multiple layer mesh or weave material) that filter sand and other wellbore debris from the fluids 122. In an example, the filtering portions 202*a* and 202*b* may not wrap all the way around the tubular 119. That is, each of the filtering portions 202*a* and 202*b* may be installed over a portion of the circumference of the tubular 119 rather than around an entire circumference of the tubular 119. By covering only a portion of the circumference of the tubular 119, the costs associated with installation of the sand screens 114*a* and 114*b* may be reduced due to a reduction in filtering material used by the filtering portions 202*a* and 202*b*. Further, costs may be reduced by reducing an amount of perforation into the formation 108 and also reducing an amount of welding and related heat-treating inherent to a traditionally welded product. Moreover, a strip of filtration media in the filtering portions 202*a* and 202*b* may be positioned along a length of tubular 119, where a sand screen wrapping a circumference of the tubular 119 would service a shorter length of the formation 108 with a similar amount of filtration media.

Bonding elements 204*a*-204*d* may be made from a composite resin, such as Protech™ or other similar materials, that is bonded directly to the tubular 119. In one or more examples, the composite resin may be a carbon fiber ceramic material that is carbon dioxide and hydrogen sulfide resistant. The bonding elements 204*a*-204*d* may exhibit high adhesion and mechanical integrity. Accordingly, the bonding elements 204*a*-204*d* may be used to install the filtering portions 202*a* and 202*b* to the tubular 119. Further, the bonding elements 204*a*-204*d* may be installed, along with the filtering portions 202*a* and 202*b*, by unskilled laborers at the wellsite (e.g., without skilled welders). For example, the unskilled workers may position the filtering portions 202*a* and 202*b* over a portion of the tubular 119, and apply the bonding elements 204*a*-204*d* or other bonding materials into appropriate sizes and shapes to achieve a bond and seal between the filtering portions 202*a* and 202*b* and the tubular 119.

The bonding elements 204*a*-204*d* may be molded to also function as centralizers for the tubular 119. For example, a thickness 206 of the bonding elements 204*a*-204*d* extending from the tubular 119 may be sufficient to maintain the tubular 119 in a generally centralized orientation within the wellbore 102. Using the bonding elements 204*a*-204*d* as centralizers may be particularly useful in the horizontal section 106 of the wellbore 102 to maintain clearance between the filtering portions 202*a* and 202*b* and the walls of the wellbore 102.

One or more of the bonding elements 204*a*-204*d* may include fluting 208 along a length of the bonding elements 204*a*-204*d*. The fluting 208 may reduce fluid resistance resulting from the bonding elements 204*a*-204*d* as the tubular 119 is run into the wellbore 102. The fluting 208 may be added to the bonding elements 204*a*-204*d* during the molding process of the composite resin material or other adhesive substance used to make the bonding elements 204*a*-204*d*.

Further, one or more cables 210 (e.g., power cables, control lines, or both) may be molded into one or more of the bonding elements 204*a*-204*d*. The cables 210 may provide power or control signals to downhole equipment, and the bonding elements 204*a*-204*d* may protect the cables 210 while the tubular 119 is run into the wellbore 102. Further, the cables 210 may be molded completely within the bonding elements 204*a*-204*d*, as depicted in FIG. 2, or the cables 210 may be positioned within a recessed groove of the bonding elements 204*a*-204*d* that run a length of the bonding elements 204*a*-204*d* on the tubular 119. The cables 210 may be fiber optic lines, electrical lines, or any other suitable type of power cable or control line.

In the illustrated example of FIG. 2, the tubular 119 includes through-ports 212 that enable passage of the fluids 122 from the formation 108 into the tubular 119. The through-ports 212 may be circular holes cut into the tubular 119 under the sand screens 114*a* and 114*b*, slits cut into the tubular 119 under the sand screens 114*a* and 114*b*, or any other types of passages that allow the fluid 122 to flow into the tubular 119. Further, the through-ports 212 may be sections that are removed from the tubular 119 extending along a length of the sand screens 114*a* and 114*b*. The through-ports 212 may extend from an outer surface 213 of the tubular 119 to an inner surface 215 of the tubular 119.

In an additional embodiment, the sand screen 114 may be positioned over a solid portion of the tubular 119 with a space between the filtering portion 202*a* or 202*b* and the solid portion of the tubular 119. At one or more of the bonding elements 204*a*-204*d*, an inflow control device 116 may be positioned that provides a path for a flow of the fluid 122 from the sand screen 114 to an interior 214 of the tubular 119. The inflow control device 116 may regulate an influx of the fluid 122 to the interior 214 of the tubular 119 during a production operation.

Figure 3:
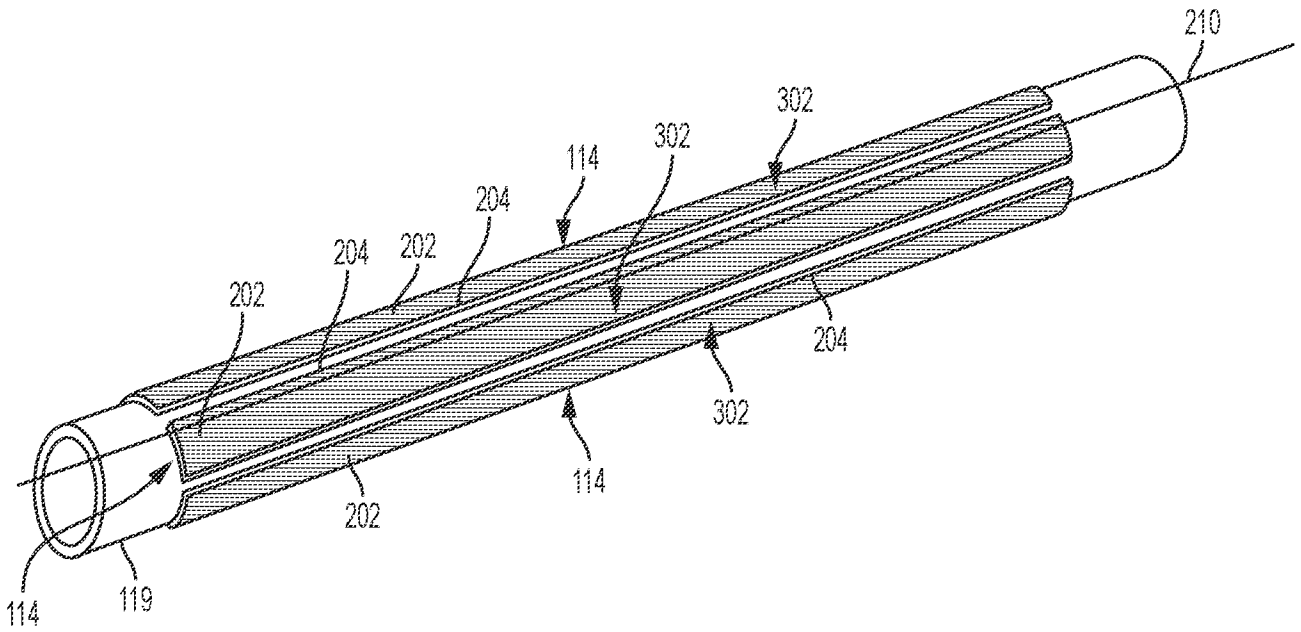
FIG. 3 is a perspective view of a section of a tubular according to some aspects of the present disclosure.

FIG. 3 is a perspective view of a section of the tubular 119 according to some aspects. In the illustrated example, the tubular 119 includes a plurality of areas 302 (e.g., a through-port 212) from which a section of the tubular 119 was removed. For example, portions of the tubular 119 positioned beneath the filtering portions 202 of the sand screens 114 may be cut and removed from the tubular 119. The areas 302 may be covered by the sand screens 114 including the filtering portions 202 and the bonding elements 204. In one or more examples, instead of the entire area 302 being an opening, the area 302 may be a field of holes or other through-ports 212, as described above with respect to FIG. 2.

Further, the cable 210 may be run along the tubular 119. In an example, the cable 210 is molded into the bonding element 204 of one of the sand screens 114 attached to the tubular 119. As discussed above with respect to FIG. 2, molding the cable 210 into the bonding element 204 may provide the cable 210 with protection when the tubular 119 is run into the wellbore 102.

Figure 4:
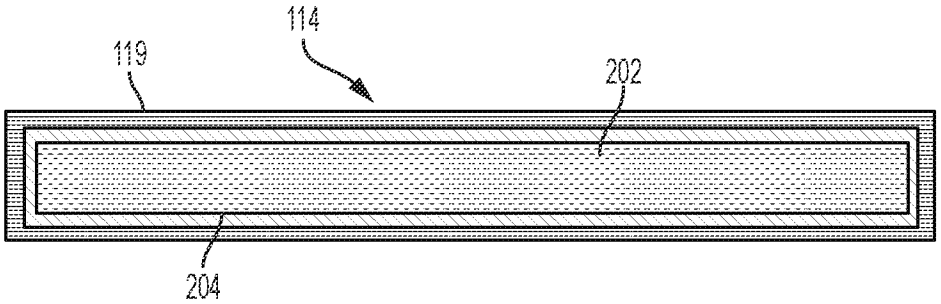
FIG. 4 is an overhead view of a sand screen installed on the tubular of FIG. 3 according to some aspects of the present disclosure.

FIG. 4 is an overhead view of an example of the sand screen 114 installed on the tubular 119 according to some aspects. In an example, the sand screen 114 may be installed on the tubular 119 over the area 302, or over any through-ports 212, of the tubular 119. The sand screen 114 may include the filtering portion 202 attached to the tubular 119 with the bonding element 204.

As discussed above with respect to FIG. 2, the bonding element 204 may be made from a composite resin, such as Protech™ or other similar materials, that is bonded directly to the tubular 119. In an example, the bonding element 204 includes structural details, such as fluting, to reduce fluid resistance resulting from the sand screen 114 as the tubular 119 runs into the wellbore 102. Further, the bonding element 204 may function as a centralizer to maintain the tubular 119 at a minimum distance (e.g., the thickness 206 of the bonding element 204) from a wall of the wellbore 102 on a side of the tubular 119 including the sand screen 114.

While the sand screen 114 is depicted as being installed over a length of the tubular 119, in another embodiment, the sand screen 114 may be positioned around a circumference of the tubular 119. In such an embodiment, the bonding element 204 may be two separate, parallel bonding elements 204 instead of a continuous bonding element 204 on four sides of the filtering portion 202 depicted in FIG. 4. Further, the bonding element 204 may be molded and attached to the tubular 119 at a well site without reliance on welding operations or skilled labor capable of performing the welding operations and other related operations (e.g., heat treating, stress relieving, etc.).

Figure 5:
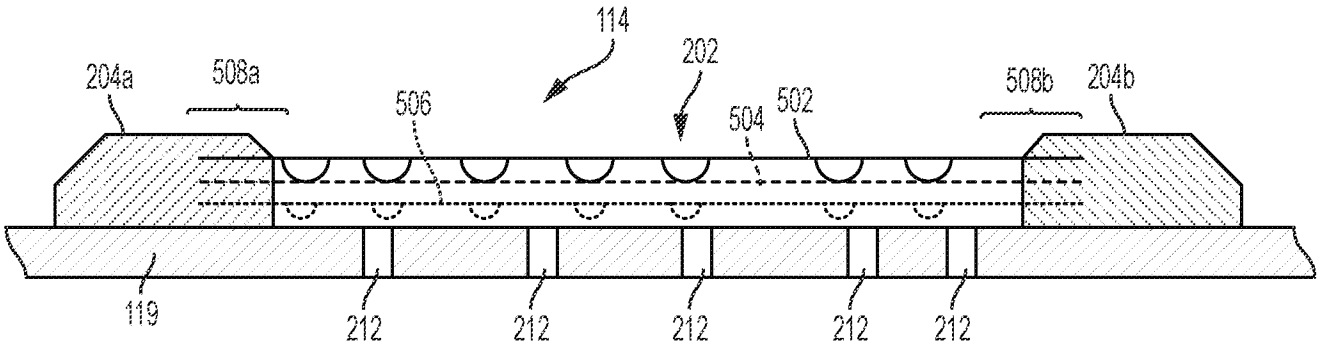
FIG. 5 is a cross-sectional schematic view of a sand screen installed on the tubular of FIG. 3 according to some aspects of the present disclosure.

FIG. 5 is a cross-sectional schematic view of the sand screen 114 installed on the tubular 119 according to some aspects. The sand screen 114 may include the filtering portion 202 of the sand screen 114 in addition to the bonding elements 204*a* and 204*b*. The filtering portion 202 may include a protective shroud 502, a mesh filter 504, and a drainage layer 506. In an example, the protective shroud 502 protects the filtering portion 202 from debris within the wellbore 102 while the sand screen 114 filters the fluid 122 or while the tubular 119 runs into the wellbore 102. The mesh filter 504 may be made from a fine mesh to prevent sand and other fine debris from entering the tubular 119. Further, the drainage layer 506 may provide stability to the mesh filter 504 while allowing the fluid 122 to enter the tubular 119 via the through-ports 212.

Ends 508*a* and 508*b* of the filtering portion 202 may be molded within the bonding elements 204*a* and 204*b*, and the bonding elements 204*a* and 204*b* create a sand-tight seal between the sand screen 114 and the tubular 119. While only the two bonding elements 204*a* and 204*b* are depicted in FIG. 5, in an embodiment where the filtering portion 202 covers a rectangular section of the tubular 119, two additional bonding elements 204 (not shown) may couple to the either side of the bonding elements 204*a* and 204*b* at right angles to attach the filtering portion 202 to the tubular 119.

Further, welding, stress relief, and non-destructive examination (NDE) associated with welding sand screens 114 to tubulars 119 may be avoided. Because the filtering portion 202 is not welded to the tubular 119, the filtering portion 202 may be made from materials that are not generally capable of withstanding heat associated with a welding operation. For example, the filtering portion 202 may be made from plastics or metals with melting points that are less than a temperature resulting from the welding operation when the bonding elements 204*a* and 204*b* are used to attach the filtering portion 202 to the tubular 119.

Figure 6:
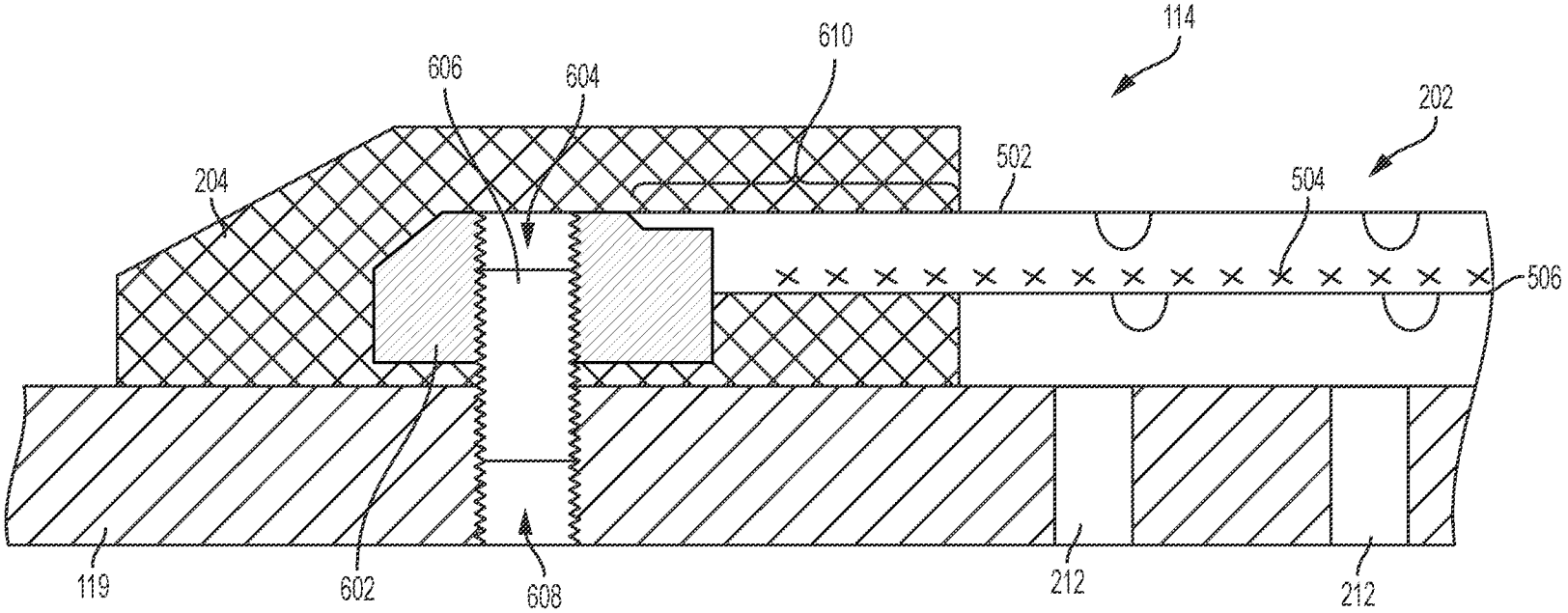
FIG. 6 is a cross-sectional schematic view of an example installation of a sand screen to the tubular of FIG. 3 according to some aspects of the present disclosure.

FIG. 6 is a cross-sectional schematic view of another example installation of the sand screen 114 to the tubular 119 according to some aspects. The filtering portion 202 may be coupled to the tubular 119 with an end ring 602 attached to the protective shroud 502. The end ring 602 may include an orifice 604 that retains a bolt 606 or other mechanical fastener that is able to attach the end ring 602 to the tubular 119. The bolt 606 may also be received in an additional orifice 608 that extends through a wall of the tubular 119 or that extends through a portion of the wall of the tubular 119 (e.g., a blind hole). The bolt 606 and end ring 602 may place the filtering portion 202 in an appropriate position relative to the through-ports 212 of the tubular 119. Once placed in the appropriate position, the bonding element 204 may be molded over the end ring 602 and the filtering portion 202 to seal the end ring 602 and the filtering portion 202 to the tubular 119 in a sand-tight seal. In such an embodiment, the end ring 602 may provide a primary mechanical attachment of the filtering portion 202 to the tubular 119, while the bonding element 204 seals an end 610 of the filtering portion 202 to provide a sand control function of the sand screen 114. In another embodiment, the bonding element 204 may be replaced with another sealing material capable of forming the sand-tight seal between the filtering portion 202 and the tubular 119.

The bonding elements 204 may be slightly raised or significantly raised over the protective shroud 502. Further, blades or channels (e.g., the fluting 208 described above with respect to FIG. 2) may be added to the bonding elements 204 to function as a centralizer for the tubular 119. The filtering portion 202 may include the protective shroud 502, the mesh filter 504, the drainage layer 506, or any combination thereof. Moreover, the filtering portion 202 may include a slip-on wire wrap screen jacket, a pre-packed screen, a direct wrap-on-pipe screen, stacks of mesh-laminate discs, or other sintered laminates that fit over the through-ports 212.

Figure 7:
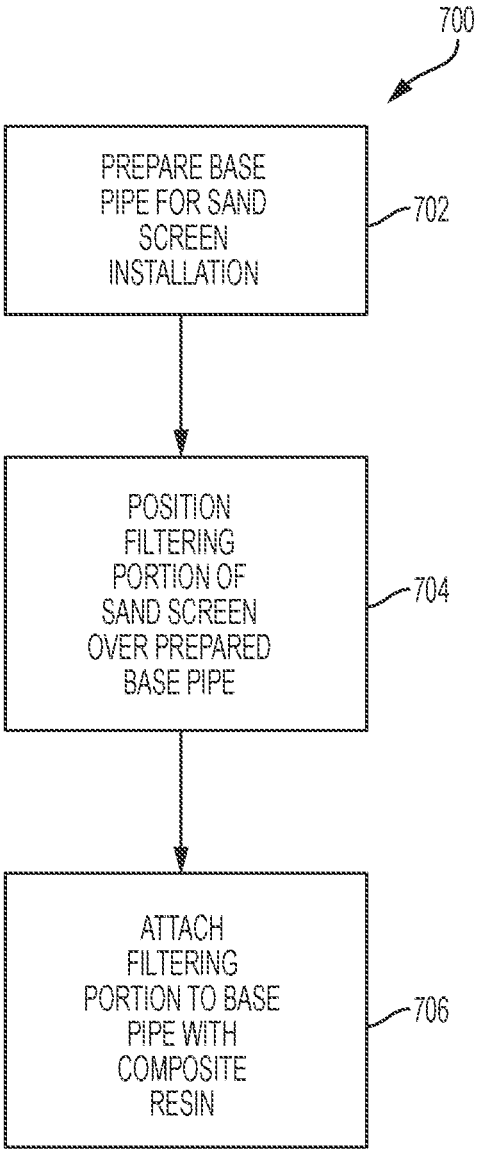
FIG. 7 is a flowchart of a process for manufacturing a sand screen system according to some aspects of the present disclosure.

FIG. 7 is a flowchart of a process 700 for manufacturing the sand screen 114 on the tubular 119 according to some aspects. At block 702, the process 700 involves preparing the tubular 119 for installation of the sand screen 114. Preparation of the tubular 119 may include drilling or otherwise cutting the through-ports 212 into the tubular 119. The through-ports 212 enable a flow of the fluid 122 from the sand screen 114 into the interior 214 of the tubular 119 for production of the fluid 122 to a surface of the wellbore 102. In another example, the area 302 of the tubular 119 may be removed to enable passage of the fluid 122 into the interior 214 of the tubular 119. Other types of passages through the tubular 119 are also contemplated.

At block 704, the process 700 involves positioning the filtering portion 202 of the sand screen 114 over the prepared portion of the tubular 119. For example, the filtering portion 202 may be positioned over the through-ports 212, the area 302, or any other openings in the tubular 119. Further, in an embodiment with an inflow control device 116, the inflow control device 116 may be positioned over the prepared portion of the tubular 119 while the filtering portion 202 is positioned adjacent to the inflow control device 116. Additionally, the filtering portion 202 may include the protective shroud 502, the mesh filter 504, the drainage layer 506, or any combination thereof. In one or more examples, the filtering portion 202 may include a slip-on wire wrap screen jacket, a pre-packed screen, a direct wrap-on-pipe screen, or stacks of mesh-laminate discs that fit over the through-ports 212, the area 302, or any other openings in the tubular 119.

In an example, positioning the filtering portion 202 of the sand screen 114 over the prepared portion of the tubular 119 may involve bolting or otherwise mechanically attaching the end ring 602, which is also coupled to the filtering portion 202, to the tubular 119. Bolting or attaching the end ring 602 to the tubular 119 may provide structural support to the filtering portion 202 and may also ensure that the filtering portion 202 is located in a correct position in relation to the prepared portion of the tubular 119.

At block 706, the process 700 involves attaching the filtering portion 202 to the tubular 119 with composite resin or other adhesive material (e.g., the bonding element 204). The bonding element 204 (e.g., a composite resin or other adhesive) is molded over the ends 508 or 610 of the filtering portion 202 to create the sand screen 114. The bonding element 204 also attaches to the tubular 119 to generate a sand-tight seal between the filtering portion 202 and the tubular 119. In one or more examples, the bonding element 204 may extend to a specified depth from the tubular 119 to function as a centralizer for the tubular 119. Further, the bonding element 204 may include fluting to reduce fluid resistance as the tubular 119 is run into the wellbore 102.

During the molding process of the bonding element 204, the cables 210 (e.g., power cables, control lines, or both) may be molded into the bonding element 204. Molding the cables 210 into the bonding element 204 may provide protection for the cables 210 as the tubular 119 is run into the wellbore 102. For example, the bonding element 204 may rub against walls of the wellbore 102 during run-in instead of the cables 210 themselves.

In some aspects, systems, devices, and methods for implementing and manufacturing a sand screen system are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system, comprising: a tubular comprising at least one through-port from an outer surface of the tubular to an inner surface of the tubular; a filtering portion positioned on the outer surface of the tubular in fluid communication with the at least one through-port; and a moldable material coupling the filtering portion to the tubular.

Example 2 is the system of example 1, wherein the moldable material extends from the tubular to a moldable material depth to centralize the tubular when installed within a wellbore by maintaining the tubular at the moldable material depth from a wall of the wellbore.

Example 3 is the system of example 1 or 2, wherein the filtering portion comprises a protective shroud, a mesh filter, and a drainage layer.

Example 4 is the system of examples 1 to 3, further comprising a mechanical fastener that couples the filtering portion to the tubular, wherein the moldable material is molded over the filtering portion and the mechanical fastener.

Example 5 is the system of examples 1 to 4, wherein the moldable material comprises a carbon fiber ceramic material.

Example 6 is the system of examples 1 to 5, further comprising a power cable or a control line disposed within the moldable material to protect the power cable or the control line from interaction with a wall of a wellbore when the tubular is run into the wellbore.

Example 7 is the system of examples 1 to 6, wherein the moldable material is moldable to a first shape associated with a second shape of the filtering portion.

Example 8 is the system of examples 1 to 7, wherein the filtering portion is positionable to filter wellbore debris from production fluid.

Example 9 is the system of examples 1 to 8, wherein the tubular is attachable to a hydrocarbon production tubing string.

Example 10 is a method of manufacturing a sand screen system, comprising: installing at least one through-port in a tubular from an outer surface of the tubular to an inner surface of the tubular; positioning a filter portion of a sand screen on the outer surface of the tubular in fluid communication with the at least one through port; and attaching the filter portion of the sand screen to the tubular with a moldable material in a sand-tight seal.

Example 11 is the method of example 10, further comprising molding the moldable material to function as a centralizer of the tubular, wherein the moldable material extends from the tubular to a moldable material depth to centralize the tubular when installed within a wellbore by maintaining the tubular at the moldable material depth from a wall of the wellbore.

Example 12 is the method of example 10 or 11, further comprising: installing an orifice in the tubular; and attaching an end ring to the tubular with a mechanical fastener disposed in the orifice of the tubular and an additional orifice of the end ring, wherein the end ring is coupled to the filter portion.

Example 13 is the method of example 12, wherein the moldable material is installed over the end ring.

Example 14 is the method of examples 10 to 13, wherein the filter portion of the sand screen is a slip-on mesh jacket, a slip-on wire wrap jacket, a pre-packed screen, a direct wrap-on-pipe screen, or stacks of mesh-laminate discs.

Example 15 is the method of examples 10 to 14, further comprising molding fluting into the moldable material.

Example 16 is the method of examples 10 to 15, further comprising installing at least one power cable or control line in the moldable material to protect the at least one power cable or control line from interaction with a wall of a wellbore when the tubular is run into the wellbore.

Example 17 is a system, comprising: a sand screen positionable on an outer surface of a tubular; and an adhesive coupled to the sand screen and couplable to the tubular.

Example 18 is the system of example 17, further comprising an inflow control device coupled to the sand screen and couplable to the tubular with the adhesive, wherein the inflow control device is positionable to regulate a flow of fluid from the sand screen to at least one through-port of the tubular.

Example 19 is the system of example 17 or 18, further comprising at least one power cable or control line molded into the adhesive to protect the at least one power cable or control line from interaction with a wall of a wellbore when the tubular is run into the wellbore.

Example 20 is the system of examples 17 to 19, wherein the adhesive comprises a carbon fiber ceramic material.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system, comprising:

a tubular comprising at least one through-port from an outer surface of the tubular to an inner surface of the tubular;

a filtering portion positioned on the outer surface of the tubular in fluid communication with the at least one through-port; and a moldable material coupling the filtering portion to the tubular, wherein the moldable material is in direct contact with the filtering portion.

2. The system of claim 1, wherein the moldable material extends from the tubular to a moldable material depth to centralize the tubular when installed within a wellbore by maintaining the tubular at the moldable material depth from a wall of the wellbore.

3. The system of claim 1, wherein the filtering portion comprises a protective shroud, a mesh filter, and a drainage layer.

4. The system of claim 1, further comprising a mechanical fastener that couples the filtering portion to the tubular, wherein the moldable material is molded over the filtering portion and the mechanical fastener.

5. The system of claim 1, wherein the moldable material comprises a carbon fiber ceramic material.

6. The system of claim 1, further comprising a power cable or a control line disposed within the moldable material to protect the power cable or the control line from interaction with a wall of a wellbore when the tubular is run into the wellbore.

7. The system of claim 1, wherein the moldable material is moldable to a first shape associated with a second shape of the filtering portion.

8. The system of claim 1, wherein the filtering portion is positionable to filter wellbore debris from production fluid.

9. The system of claim 1, wherein the tubular is attachable to a hydrocarbon production tubing string.

10. A method of manufacturing a sand screen system, comprising:

installing at least one through-port in a tubular from an outer surface of the tubular to an inner surface of the tubular;

positioning a filter portion of a sand screen on the outer surface of the tubular in fluid communication with the at least one through port; and attaching the filter portion of the sand screen to the tubular with a moldable material in direct contact with the tubular the sand screen for forming a sand-tight seal.

11. The method of claim 10, further comprising molding the moldable material to function as a centralizer of the tubular, wherein the moldable material extends from the tubular to a moldable material depth to centralize the tubular when installed within a wellbore by maintaining the tubular at the moldable material depth from a wall of the wellbore.

12. The method of claim 10, further comprising:

installing an orifice in the tubular; and attaching an end ring to the tubular with a mechanical fastener disposed in the orifice of the tubular and an additional orifice of the end ring, wherein the end ring is coupled to the filter portion.

13. The method of claim 12, wherein the moldable material is installed over the end ring.

14. The method of claim 10, wherein the filter portion of the sand screen is selecting from a group consisting of a slip-on mesh jacket, a slip-on wire wrap jacket, a pre-packed screen, a direct wrap-on-pipe screen, or stacks of mesh-laminate discs.

15. The method of claim 10, further comprising molding fluting into the moldable material.

16. The method of claim 10, further comprising installing at least one power cable or control line in the moldable material to protect the at least one power cable or control line from interaction with a wall of a wellbore when the tubular is run into the wellbore.

17. A system, comprising:

a sand screen positionable on an outer surface of a tubular; and a moldable material coupled to the sand screen and to the tubular to form a sand-tight seal, wherein the moldable material is in direct contact with the sand screen.

18. The system of claim 17, further comprising an inflow control device coupled to the sand screen and couplable to the tubular with the adhesive, wherein the inflow control device is positionable to regulate a flow of fluid from the sand screen to at least one through-port of the tubular.

19. The system of claim 17, further comprising at least one power cable or control line molded into the adhesive to protect the at least one power cable or control line from interaction with a wall of a wellbore when the tubular is run into the wellbore.

20. The system of claim 17, wherein the adhesive comprises a carbon fiber ceramic material.

* * * * *